US005775625A

United States Patent [19]

Shimomura

[11] Patent Number: 5,775,625

[45] Date of Patent: Jul. 7, 1998

[54] COVER STRIP FOR FACILITATING PAY OFF OF LINE FROM A SPOOL

[76] Inventor: Hideo Shimomura, 511 Hingham La., Schaumburg, Ill. 60193

[21] Appl. No.: 798,776

[22] Filed: Feb. 11, 1997

[51] Int. Cl.[6] ..... B65H 59/02; B65H 75/28; B65H 49/00

[52] U.S. Cl. ..... 242/422.6; 242/125.3; 242/129; 242/566; 242/580; 242/588.6

[58] Field of Search ..... 242/128, 129, 242/125.3, 171, 172, 422.6, 566, 580, 588.6

[56] References Cited

U.S. PATENT DOCUMENTS

| | | | |
|---|---|---|---|
| 534,535 | 2/1895 | Walter | 242/125.3 |
| 3,942,736 | 3/1976 | Ramos | 242/566 X |
| 4,787,168 | 11/1988 | Benit et al. | 242/588.6 X |
| 5,074,484 | 12/1991 | Kray | 242/588 X |
| 5,639,043 | 6/1997 | Baird | 242/422.6 X |

*Primary Examiner*—Michael Mansen
*Attorney, Agent, or Firm*—Wood, Phillips, VanSanten, Clark & Mortimer

[57] ABSTRACT

The combination of a spool having a core with a central axis, a supply of flexible line with a plurality of turns wrapped over the core around the central axis, and a control strip having a body which in an operative state on the core extends around the core over the supply of flexible line to prevent the flexible line from inadvertently unwrapping. The core is movable relative to the control strip around the central axis. A gripping portion on the control strip is graspable to hold the control strip substantially stationary while rotating the core around the core axis. An opening is provided through the control strip, with the flexible line extending from one of the turns of the flexible line through the control strip opening to a useable portion of the flexible line that projects outwardly from the control strip. The control strip opening is located so that with the user simultaneously grasping the gripping portion of the control strip and the useable portion of the flexible line and exerting oppositely directed forces thereon in a first line, the useable portion of the flexible line projects from the one turn in a second line that is substantially tangent to the one turn and parallel to the first line.

21 Claims, 2 Drawing Sheets

PRIOR ART
Fig. 4
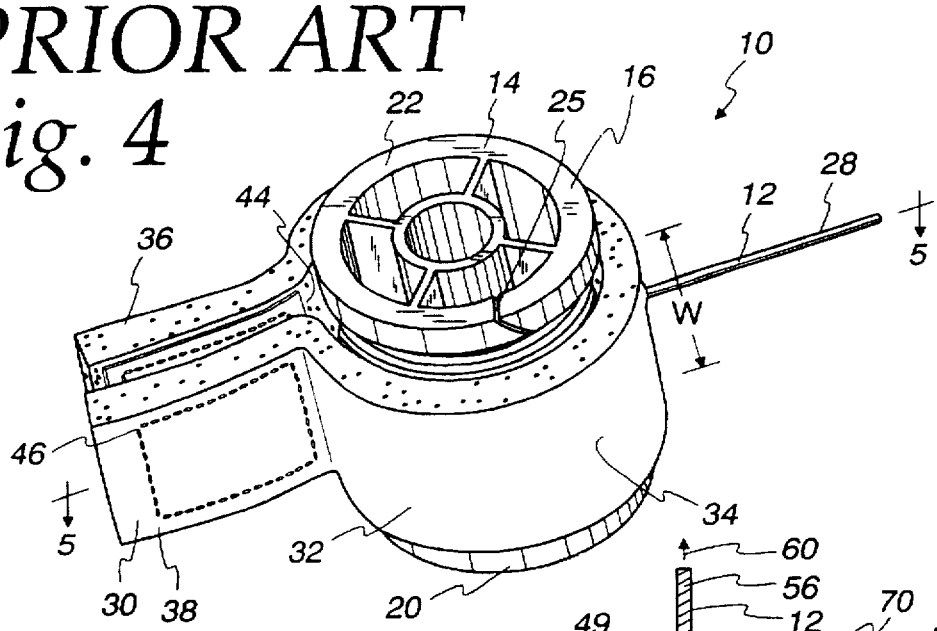
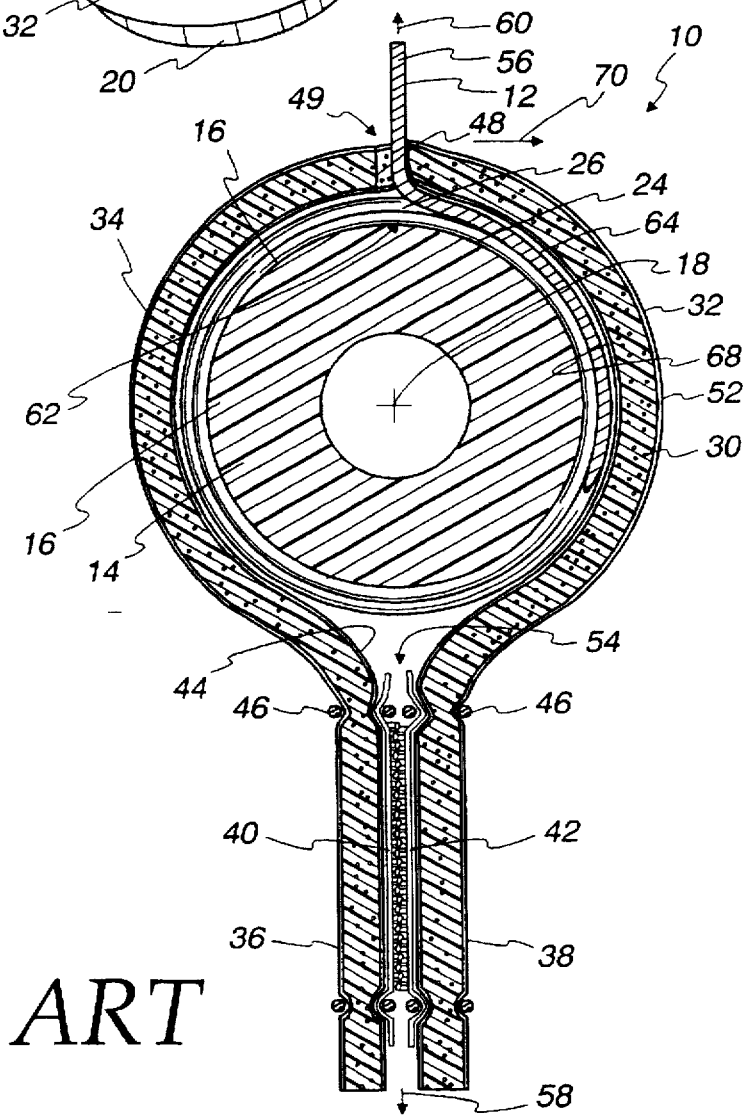
Fig. 5
PRIOR ART

COVER STRIP FOR FACILITATING PAY OFF OF LINE FROM A SPOOL

BACKGROUND OF THE INVENTION

1. Field of the Invention

This invention relates to spools having a supply of flexible line wrapped therearound and, more particularly, to a spool with a cover strip thereon that facilitates controlled pay off of line from the spool.

2. Background Art

There are many environments in which flexible line wrapped around a spool is required to be controllably paid off. In one exemplary environment, discrete amounts of a flexible line are drawn off of a spool to facilitate tying of flies for fishing. During such tying operations, multiple spools with different color, test, and type of line may be used, thereby requiring that they all be kept on hand and readily accessible.

With many lines, the turns on the spool tend to expand and unwind when the free end of the line is not tensioned. The unwound line on a particular spool may tangle on its own spool, which inhibits the smooth pay off of line therefrom. The unwound line from one spool may entangle with line from other spools which further aggravates the user's task. This condition can be witnessed in sewing kits, in which thread from many spools is entangled as well as wrapped around other items in the kit.

To prevent inadvertent pay off of line from a spool, it is known to employ a cover strip on the spool. Typically, a flexible foam material is used to form the cover strip. The cover strip has a width approximately equal to the axial dimension of the spool so that substantially all of the turns of the line can be covered by the strip. The cover strip is wrapped into a U shape around the spool so that the strip ends can be brought together. In one form, Velcro-type fastener sheets on the strip ends allow the strip ends to be releasably united. The length of the cover strip is chosen, and the Velcro-type fastener sheets are located, so that with the cover strip ends even, the cover strip snugly embraces the spool and the ends thereof project radially away from the spool in a line that bisects the spool. An opening is provided through the cover strip diametrically opposite to the location where the cover strip ends project.

With this arrangement, the turns of the line are substantially confined on the spool by the cover strip. When it is desired to draw the line off of the spool, the user gasps the joined ends of the cover strip with one hand and with the other hand grasps the useable portion of the line projecting outwardly from the spool through the cover strip opening. The cover strip thereby remains fixed with the force exerted on the useable portion of the line imparting a rotative force to the spool to thereby release the line.

The above cover strip has a number of inherent drawbacks. First of all, the cover strip is designed for a limited range of spool diameters. It is intended that the ends of the cover strip be matched to maximize the holding force produced between the Velcro-type fastener sheets thereon and to provide the most convenient gripping configuration for the user. Each cover strip functions optimally with one particular diameter. That is, with the ends of the strip joined, the strip snugly embraces the spool but does not do so with a force sufficient to significantly inhibit rotation of the spool within the cover strip to thereby allow the line to smoothly pay off. A spool that is too small will not be properly engaged by the cover strip. In this situation, the spool could release altogether from the cover strip. Alternatively, turns of line could release from the spool and become entangled. A spool that is too large will be too tightly held by the cover strip.

Another problem with this conventional cover strip is that multiple manufacturing steps are required to produce it. A first step is required to cut the strip to length. The Velcro-type fastener sheets must then likewise be cut to the desired length and sewn at both ends of the strip. This inevitably adds considerable time and cost to manufacture.

A further problem with the above-described cover strip is that the passage of line through the cover strip opening is inhibited by reason of the location of the opening. In operation, the user draws the strip ends and useable portion of the line in opposite directions in a first line that substantially bisects the spool, i.e. extends through the spool axis. Rather than producing primarily a tangential rotative force on the spool through this action, only a component of the drawing force is initially tangential. Instead, a substantial force is exerted by the tensioned line radially relative to the spool against the inwardly facing surface of the cover strip. This not only causes a binding which inhibits spool rotation within the cover strip, but also may eventually lead to tearing of the strip. That is, the taut line may cut through the strip so as to effectively and undesirably enlarge the opening. Once this occurs, the line becomes wedged in a newly formed cut, which inhibits free pay off of line. Replacement of the strip may be necessitated.

SUMMARY OF THE INVENTION

In one form, the invention contemplates the combination of a spool having a core with a central axis, a supply of flexible line with a plurality of turns wrapped over the core around the central axis, and a control strip having a body which in an operative state on the core extends around the core over the supply of flexible line to prevent the flexible line from inadvertently unwrapping. The core is movable relative to the control strip around the central axis. A gripping portion on the control strip is graspable to hold the control strip substantially stationary while rotating the core around the core axis. An opening is provided through the control strip, with the flexible line extending from one of the turns of the flexible line through the control strip opening to a useable portion of the flexible line that projects outwardly from the control strip. The control strip opening is located so that with the user simultaneously grasping the gripping portion of the control strip and the useable portion of the flexible line and exerting oppositely directed forces thereon in a first line, the useable portion of the flexible line projects from the one turn in a second line that is substantially tangent to the one turn and parallel to the first line.

The control strip body may be made from a stretchable material, such as foam.

In one form, with the control strip in the operative state, one part of the control strip extends through another part of the control strip.

Shoulders can be provided on each of the one and the another part of the control strip that cooperate to releasably maintain the control strip in the form of a ring with a first diameter.

Multiple shoulders can be provided on each of the one and the another part of the control strip that cooperate to releasably selectively maintain the strip in the form of a) a ring with a first diameter and b) a ring with a second diameter.

In one form, the one part of the control strip has a V-shaped edge and the another part of the control strip has a second opening therethrough, with the V-shaped opening being larger than the second opening and progressively enlarging the second opening as the one part of the control strip is directed through the second opening.

In one form, the control strip body has free ends and there is structure on the body for releasably maintaining the body in the form of a ring. The structure for doing this may allow the one part of the body to be pressed against and thereby releasably held to the another part of the body. Velcro-type fastener material is suitable for this purpose.

In one form, the control strip consists of a single piece cut from a sheet of material.

In one form, the control strip in the operative state defines a ring with a circumference, with the gripping portion being at a first location on the circumference of the ring and the opening at a second location on the circumference of the ring. The first and second locations are spaced from each other by less than 180° around the circumference of the ring. The first and second locations may be spaced from each other by less than 160°.

The invention further contemplates the combination of a spool having a core with a central axis, a supply of flexible line with a plurality of turns wrapped over the core around the central axis, and a control strip having a body which in an operative state on the core defines a ring with a circumference that extends around the core over the supply of flexible line to prevent the flexible line from inadvertently unwrapping. The core is movable relative to the control strip around the central axis. There is a gripping portion on the control strip at a first location on the circumference of the ring which can be grasped to hold the control strip substantially stationary while rotating the core around the core axis. An opening is provided through the control strip at a second location spaced from the first location through less than 180° around the circumference of the ring. With the flexible line extending through the control strip opening, a user can simultaneously grasp the gripping portion of the control strip and the portion of the flexible line projecting from the control strip and draw the gripping portion of the control strip and the flexible line away from each other to draw the flexible line off the spool.

The gripping portion of the control strip may be a part that projects radially away from the ring at the first location.

BRIEF DESCRIPTION OF THE DRAWINGS

FIG. 4 is a view as in FIG. 2 showing a prior art control strip in an operative state on the spool;

FIG. 5 is an enlarged, cross-sectional view of the spool and control strip taken along line 5—5 of FIG. 4.

DETAILED DESCRIPTION OF THE DRAWINGS

Figure 1:
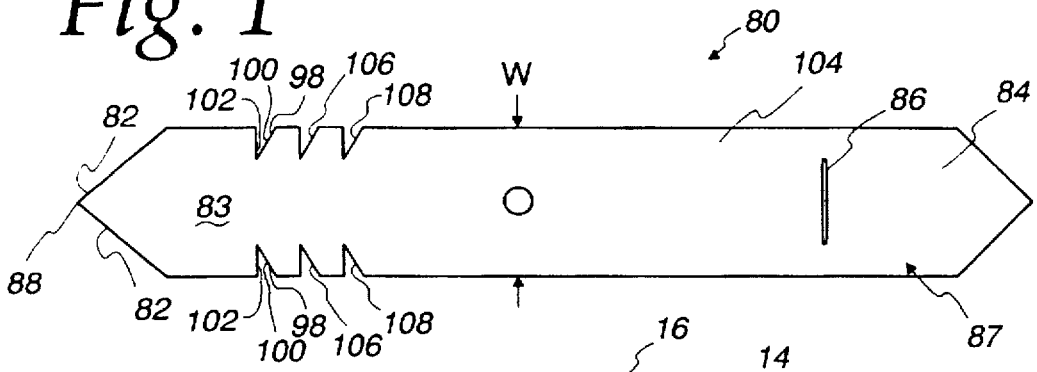
FIG. 1 is a plan view of a control strip according to the present invention.

Referring initially to FIGS. 4 and 5, a prior art system is shown at 10 for controllably paying off a flexible line 12 wound around a spool 14. The spool 14 has a conventional construction with a cylindrical core 16 having a central axis 18. The spool 14 has radially enlarged flanges 20, 22 at the axial ends thereof with the flange 22 having a slit 25 therein within which the line 12 can be wedged, as when the system 10 is stored. The flanges 20, 22 and the cylindrical outer surface 24 of the core 16 together define a storage space for the flexible line 12.

A continuous length of the flexible line 12 is wrapped around the core 16, defining a plurality of turns 26. When the user desires to pay line 12 off of the spool 14, the user can hold the spool 14 between two fingers and pull upon the free end 28 of the line 12 to rotate the spool 14 around the axis 18 and thereby unwind the line 12.

To prevent inadvertent unwinding of the line 12 from the spool 14 when the line 12 is not drawn taut, a control strip 30 is attached to the spool 14. The control strip 30 is made from a foam material and has a body 32 with an elongate, rectangular shape. The control strip body 32 has a width W that is equal to or slightly less than the axial dimension of the core outer surface 24.

The length of the body 32 of the control strip 30 is chosen so that the body 32 can be formed into the shape of a ring 34 which snugly embraces the supply of line 12 on the spool 14. With the control strip 30 in the operative state of FIGS. 4 and 5, the free ends 36, 38 of the control strip 30 are connected to each other to maintain the ring 34 on the spool 14. In this particular construction, cooperating hook and pile fastener sheets 40, 42, such as Velcro-type fastener, are attached one each on the inside surface 44 of the control strip body 32 at the ends 36, 38 thereof. The fastener sheets 40, 42 are held in place on the control strip body 32 by conventional stitching 46.

The length of the control strip body 30 is selected so that with the fastener sheets 40, 42 engaged as in FIGS. 4 and 5, the ring 34 produces a sufficient pressure around the supply of line 12 that the control strip 30 is positively maintained in the operative state of FIGS. 4 and 5. However, the embracing force exerted by the control strip 40 is loose enough to allow the spool 14 to rotate about the axis 18 within the ring 34.

To permit the paying off of line 12 from the spool 14, an opening 48 is provided through the body 32 of the control strip 30 at a first location 49 on the circumferential surface 52 of the control strip 30 that is diametrically opposite to a second location at 54 at which the body ends 36,38 are joined. That is, the first and second locations are spaced from each other 180° around the circumference of the ring 34. The joined ends 36, 38 cooperatively project radially away from the ring 34 at the second location 54 and define a gripping portion which can be conveniently grasped between two fingers by the user.

In operation, the user simultaneously grips the body ends 36, 38 and a useable portion 56 of the flexible line 12 projecting through the opening 48 and draws the ends 36,38 in the direction of the arrow 58 and the useable portion 56 of the line 12 oppositely in the direction of the arrow 60. The line of force application on both the ends 36, 38 and the line 12 extends through the spool axis 18.

With this arrangement, the line bends at 62 at an angle of approximately 110° between the usable line portion 56 and the immediately contiguous line turn 64. As a result, the force application on the line 12 in the direction of the arrow 60 causes the line 12, where bent at 62, to bear on the inside surface 68 of the control strip 30 at the opening 48. This produces a significant force component in the direction of the arrow 70 on the control strip body 32 in the opening 48, which causes the body 32 to stretch in the direction of the arrow 70 until the line 12 at 62 straightens to the point that a force component tangent to the turn 64 is of sufficient magnitude to rotate the spool 14 within the control strip 30.

One difficulty with this arrangement is that a significant binding action is produced between the line 12 and the cover strip body 32 that inhibits pay off of the line 12 from the spool 14. Since the flexible line 12 normally has a relatively small diameter, the application of a force, sufficient to produce line pay off, may cause the line 12 to cut through the control strip body 32.

As previously mentioned in the background portion herein, this control strip 30 also has the disadvantage that it is designed optimally for one diameter, with only slight variations therefrom effectively accommodated. As also noted above, the manufacture of the control strip 30 is complicated by having to perform the steps of sewing the fastener sheets 40, 42 in place.

Figure 2:
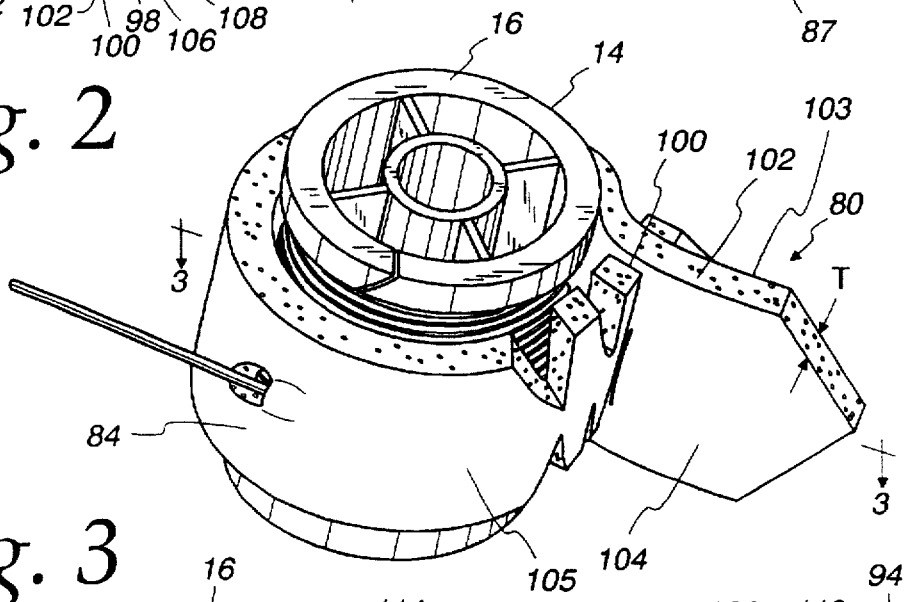
FIG. 2 is an enlarged, perspective view of a spool having a core with a supply of line thereon and with the inventive control strip in an operative state on the core with the flexible line extending through the control strip.
Figure 3:
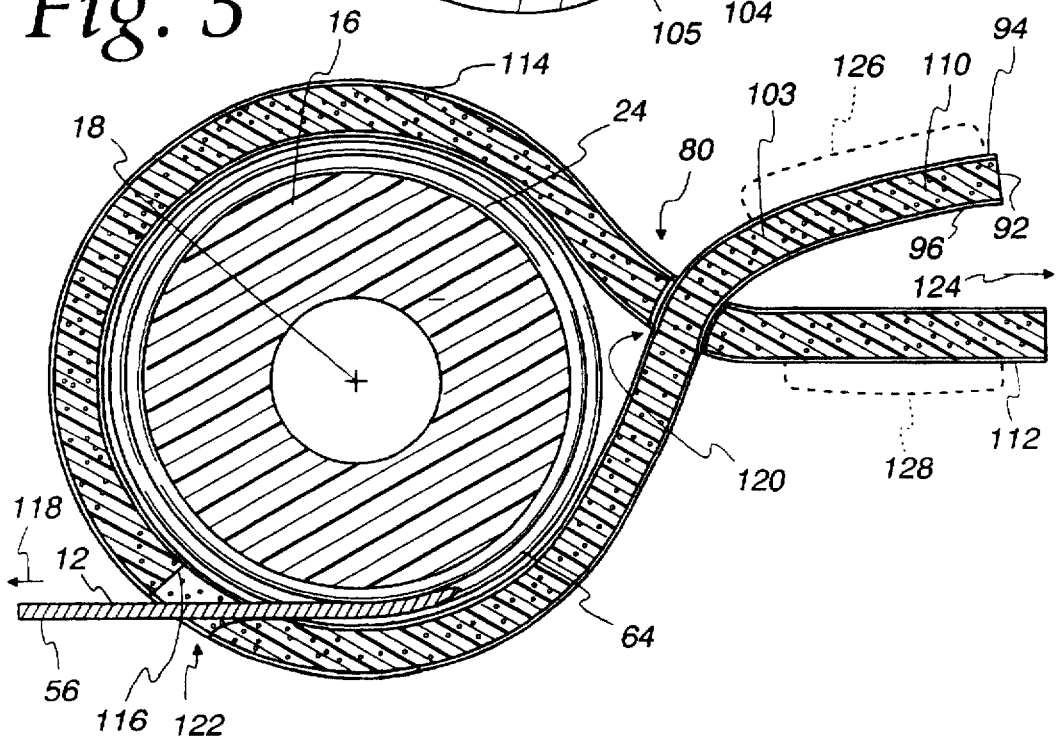
FIG. 3 is an enlarged, cross-sectional view of the spool and control strip taken along line 3—3 of FIG. 2.

The inventive control strip is shown at 80 in FIGS. 1–3. The control strip 80 shown is dimensionally accurate and works well with a spool 14 having an axial core length of one inch and an empty core diameter of approximately ⅞ inch. In FIGS. 2 and 3, the control strip 80 is shown in an operative state on the conventional spool 14, described in FIGS. 4 and 5. The control strip 80 has a width W, which is shown to be slightly less than the axial dimension of the outer surface 24 of the spool core 16.

The control strip 80 operates in the same general manner as the control strip 30. In one form, the control strip 80 obviates the need for the previously described fastener sheets 40, 42. To accomplish this, a V-shaped edge 82 is provided on one part 83 of the body 84 of the control strip 80. A slit 86 is provided in another part 87 of the body 84. By directing the free end 88 of the body 84 through the slit 86, the edge 82 will progressively enlarge the slit 86 and guide the part 83 fully through the slit 86. Enlargement of the slit 86 is made possible by forming the body 84 from a stretchable material, such as foam 92 with stretchable cloth layers 94, 96 adhered on opposite sides thereof. With this arrangement, the body part 83 compresses as the slit 86 enlarges. As the body part 83 continues to move through the slit 86, V-shaped cut-outs 98, bounded by facing shoulders 100, 102, move into the slit 86. This allows the body part 83 to spring back to a relatively undeformed state in which the thickness T of the body 84 becomes captive between the shoulders 100, 102, as shown in FIGS. 3 and 4, with the oppositely facing strip surfaces 103, 104' acting as shoulders and abutting one each to the shoulders 100, 102. In this state, the body 84 forms a ring 105 having a first diameter. Additional cut outs 106, 108 are provided and allow the body part 83 to be drawn further through the slit 86 and be maintained in two additional positions in which the ring 104 has two different and smaller diameters.

With this construction, the control strip 80 can be simply formed as one piece in one step by stamping the shape in FIG. 1 from a sheet of the cloth-covered foam material. By then simply drawing the body part 83 through the slit 86 a desired amount, the different diameters for the ring 104 can be readily selected. The body part 83 can be simply drawn out from the slit 86, which is permitted by the stretchable nature of the material making up the body 84. Accordingly, a single construction of the control strip 80 can be used with a number of different diameters of spool 14 to allow an optimum pressure to be applied by the control strip 80 on the supply of line 12 around the spool 14.

At the same time, the ends 110, 112 of the body 84 project naturally radially from the circumferential surface 114 of the ring 104 defined by the body 84. The user can conveniently grasp the ends 110, 112 between two fingers to positively hold the combined spool 14 and control strip 80.

According to the invention, an opening 116 through the ring 104 is strategically located to facilitate drawing off of the flexible line 12 without excessive resistance. More particularly, the opening 116 is located so that the useable portion 56 of the line 12 extending out of the opening 116 projects from the immediately contiguous turn 64 in a line that is substantially tangent to the turn 64. As a consequence, by exerting a force in the direction of the arrow 118, substantially the entire exerted force is converted to a torque on the spool 14 that tends to rotate the spool 14 around the axis 18.

Whereas in the prior art, the graspable free strip ends 36, 38 and the opening 48 are spaced around the circumference of the ring 34 through 180°, the corresponding locations 120, 122 are spaced less than 180° around the circumference of the ring 104. More preferably, the locations 120, 122 are spaced less than 160° around the circumference of the ring 104.

In operation, the user grips, and draws oppositely, the ends 110, 112 and the useable portion 56 of the flexible line 12. The lines of the force application in the direction of the arrows 118, 124 are opposite and substantially parallel to each other.

Since this arrangement permits the line 12 to be withdrawn without any substantial deformation of the body 84 around the opening 116, the control strip 80 may last longer than that in the prior art and is less prone to tearing as would compromise its effectiveness.

The invention also contemplates that the control strip 80 could be provided with hook and loop-type fasteners sheets 126, 128, which can be pressed against each other to maintain the ends 110, 112 together. The relationship between the ends 110, 112 and the opening 116, using the fasteners 126, 128, preferably remains the same as in FIGS. 2 and 3.

The foregoing disclosure of specific embodiments is intended to be illustrative of the broad concepts comprehended by the invention.

I claim:

1. In combination:

a spool having a core with a central axis;

a supply of a flexible line with a plurality of turns wrapped over the core around the central axis; and a control strip having a body which in an operative state on the core extends around the core over the supply of flexible line to prevent the flexible line from inadvertently unwrapping, said core being movable relative to the control strip around the central axis, there being a gripping portion on the control strip which can be grasped to hold the control strip substantially stationary while rotating the core around the core axis, there being an opening through the control strip, said flexible line extending from one of the turns through the control strip opening to a usable portion of the flexible line that projects outwardly from the control strip, said control strip opening being located so that with a user simultaneously grasping the gripping portion of the control strip and the usable portion of the flexible line and exerting oppositely directed forces on the gripping portion of the control strip and the usable portion of the flexible line in a first line to draw the usable portion of the flexible line taut, the usable portion of the flexible line projects from the one turn in a second line that is substantially tangent to the one turn and parallel to the first line, said control strip body being configured and made from material that has sufficient flexibility to allow the strip to be selectively a) wrapped conformingly around the supply of flexible line on the spool core with the control strip in the operative state and b) placed in a substantially flattened state with the control strip separated from the spool.

2. The combination according to claim 1 wherein the spool has axially spaced ends, the control strip body has a length and comprises a material which is stretchable in a lengthwise direction, and in the operative state the control strip extends through 360° around the spool and does not extend over both of the axially spaced ends of the spool.

3. The combination according to claim 1 wherein the control strip body has free ends and there is means on the body for releasably maintaining the free ends of the body together to form a ring.

4. The combination according to claim 3 wherein the means comprises means for allowing one part of the body to be pressed against and thereby releasably held to another part of the body.

5. The combination according to claim 4 wherein the means comprises a hook and loop-type fastener.

6. The combination according to claim 1 wherein the control strip body has free ends and there is means on the body for releasably maintaining the free ends of the control strip body together to thereby maintain the body selectively in the form of a) a ring with a first diameter and b) a ring with a second diameter.

7. The combination according to claim 1 wherein the control strip consists of a single piece cut from a sheet of material.

8. The combination according to claim 1 wherein the control strip in the operative state defines a ring with a circumference, the gripping portion is at a first location on the circumference of the ring and the opening is at a second location on the circumference of the ring and the first and second locations are spaced from each other by less than 180° around the circumference of the ring.

9. The combination according to claim 8 wherein the first and second locations are spaced from each other by less than 160°.

10. In combination:

a spool having a core with a central axis;

a supply of a flexible line with a plurality of turns wrapped over the core around the central axis; and a control strip having a body which in an operative state on the core extends around the core over the supply of flexible line to prevent the flexible line from inadvertently unwrapping, said core being movable relative to the control strip around the central axis, there being a gripping portion on the control strip which can be grasped to hold the control strip substantially stationary while rotating the core around the core axis, there being an opening through the control strip, said flexible line extending from one of the turns through the control strip opening to a usable portion of the flexible line that projects outwardly from the control strip, said control strip opening being located so that with a user simultaneously grasping the gripping portion of the control strip and the usable portion of the flexible line and exerting oppositely directed forces on the gripping portion of the control strip and the usable portion of the flexible line in a first line to draw the usable portion of the flexible line taut, the usable portion of the flexible line projects from the one turn in a second line that is substantially tangent to the one turn and parallel to the first line, wherein with the control strip in the operative state one part of the control strip extends through another part of the control strip.

11. The combination according to claim 10 wherein there are shoulders on each of the one and the another part of the control strip that cooperate to releasably maintain the strip in the form of a ring with a first diameter.

12. The combination according to claim 10 wherein there are shoulders on each of the one and the another part of the control strip that cooperate to releasably selectively maintain the strip in the form of a) a ring with a first diameter and b) a ring with a second diameter.

13. The combination according to claim 10 wherein the control strip comprises a stretchable material and the one part of the control strip has a V-shaped edge and the another part of the control strip has a second opening therethrough, said V-shaped edge being larger than the second opening and progressively enlarging the second opening as the one part of the control strip is directed through the second opening.

14. In combination:

a spool having a core with a central axis;

a supply of a flexible line with a plurality of turns wrapped over the core around the central axis so that the spool and flexible line define a diameter; and a control strip having a body which in an operative state on the core defines a ring extending through 360° with a circumference that extends around the core over the supply of flexible line to prevent the flexible line from inadvertently unwrapping, said core being movable relative to the control strip around the central axis, there being a gripping portion on the control strip at a first location on the circumference of the ring which can be grasped to hold the control strip substantially stationary while rotating the core around the core axis, there being an opening through the control strip at a second location spaced from the first location through less than 180° around the circumference of the ring, said flexible line extending through the control strip opening so that a usable portion of the flexible line projects outwardly from the control strip, whereby a user can simultaneously grasp the gripping portion of the control strip and the usable portion of the flexible line and draw the gripping portion of the control strip and usable portion of the flexible line away from each other to draw the flexible line off of the spool, said control strip body being sufficiently stretchable to allow the control strip to be conformingly wrapped around the spool and a supply of flexible line with the spool and supply of flexible line defining different diameters.

15. The combination according to claim 14 wherein the first and second locations are spaced from each other less than 160° around the circumference of the ring.

16. The combination according to claim 14 wherein the gripping portion on the control strip comprises a part that projects radially away from the ring at the first location.

17. The combination according to claim 14 wherein the control strip body has a first part that is releasably joinable to another part of the control strip to form the ring.

18. The combination according to claim 14 wherein there is a hook and loop-type fastener on the first part and the another part of the control strip that is connectable to form the ring.

19. The combination according to claim 14 wherein the control strip body comprises a foam material.

20. In combination:

a spool having a core with a central axis:

a supply of a flexible line with a plurality of turns wrapped over the core around the central axis; and a control strip having a body which in an operative state on the core defines a ring with a circumference that extends around the core over the supply of flexible line to prevent the flexible line from inadvertently unwrapping, said core being movable relative to the control strip around the central axis, there being a gripping portion on the control strip at a first location on the circumference of the ring which can be grasped to hold the control strip substantially stationary while rotating the core around the core axis, there being an opening through the control strip at a second location spaced from the first location through less than 180° around the circumference of the ring, said flexible line extending through the control strip opening so that a usable portion of the flexible line projects outwardly from the control strip, whereby a user can simultaneously grasp the gripping portion of the control strip and the usable portion of the flexible line and draw the gripping portion of the control strip and usable portion of the flexible line away from each other to draw the flexible line off of the spool, wherein the control strip body has a first part that is releasably joinable to another part of the control strip to form the ring, wherein the first part of the control strip is extendable through the another part of the control strip to form the ring.

21. In combination:

a spool having a core with a central axis;

a supply of a flexible line with a plurality of turns wrapped over the core around the central axis; and a control strip having a body which in an operative state on the core extends around the core over the supply of flexible line to prevent the flexible line from inadvertently unwrapping, said control strip in the operative state having one part which extends through another part of the control strip, said core being movable relative to the control strip around the central axis, there being a gripping portion on the control strip which can be grasped to hold the control strip substantially stationary while rotating the core around the core axis, there being an opening through the control strip, said flexible line extending from one of the turns through the control strip opening to a usable portion of the flexible line that projects outwardly from the control strip.

* * * * *